US008128005B2

(12) United States Patent
Magel

(10) Patent No.: US 8,128,005 B2
(45) Date of Patent: Mar. 6, 2012

(54) FUEL INJECTOR

(75) Inventor: Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 28 days.

(21) Appl. No.: 12/530,818

(22) PCT Filed: Jan. 30, 2008

(86) PCT No.: PCT/EP2008/051118
§ 371 (c)(1),
(2), (4) Date: Sep. 11, 2009

(87) PCT Pub. No.: WO2008/110406
PCT Pub. Date: Sep. 18, 2008

(65) Prior Publication Data

US 2010/0102143 A1 Apr. 29, 2010

(30) Foreign Application Priority Data

Mar. 12, 2007 (DE) ..... 10 2007 011 789

(51) Int. Cl.
*F02M 41/16* (2006.01)

(52) U.S. Cl. ..... 239/96; 239/125; 239/127; 239/132.1; 239/585.1; 239/585.3

(58) Field of Classification Search ..... 239/96, 239/124, 125, 127, 132.1–132.5, 584, 585.1, 239/585.3
See application file for complete search history.

(56) References Cited

U.S. PATENT DOCUMENTS

| | | | | |
|---|---|---|---|---|
| 2,556,356 | A * | 6/1951 | Alfaro et al. | 239/96 |
| 4,572,433 | A * | 2/1986 | Deckard | 239/125 |
| 4,603,671 | A | 8/1986 | Yoshinaga et al. | |
| 5,127,583 | A | 7/1992 | Taue | |
| 5,148,987 | A | 9/1992 | Taue | |
| 5,709,194 | A * | 1/1998 | Moncelle | 239/96 |
| 7,021,558 | B2 * | 4/2006 | Chenanda et al. | 239/125 |

FOREIGN PATENT DOCUMENTS

| | | |
|---|---|---|
| DE | 4122384 A1 | 2/1992 |
| EP | 0409264 A1 | 1/1991 |

* cited by examiner

*Primary Examiner* — Steven J Ganey
(74) *Attorney, Agent, or Firm* — Ronald E. Greigg

(57) ABSTRACT

The invention relates to a fuel injector comprising an injector housing having a pressure chamber from which fuel subjected to a high pressure is injected into a combustion chamber of an internal combustion engine when the pressure in a control chamber expands into a pressure relief chamber by a control valve device. The aim of the invention is to create a fuel injector which has a long service life even though subjected to high pressures. To this end, the injector includes a low-pressure supply line which is connected to a low-pressure return line by a purge path extending through the pressure relief chamber.

15 Claims, 1 Drawing Sheet

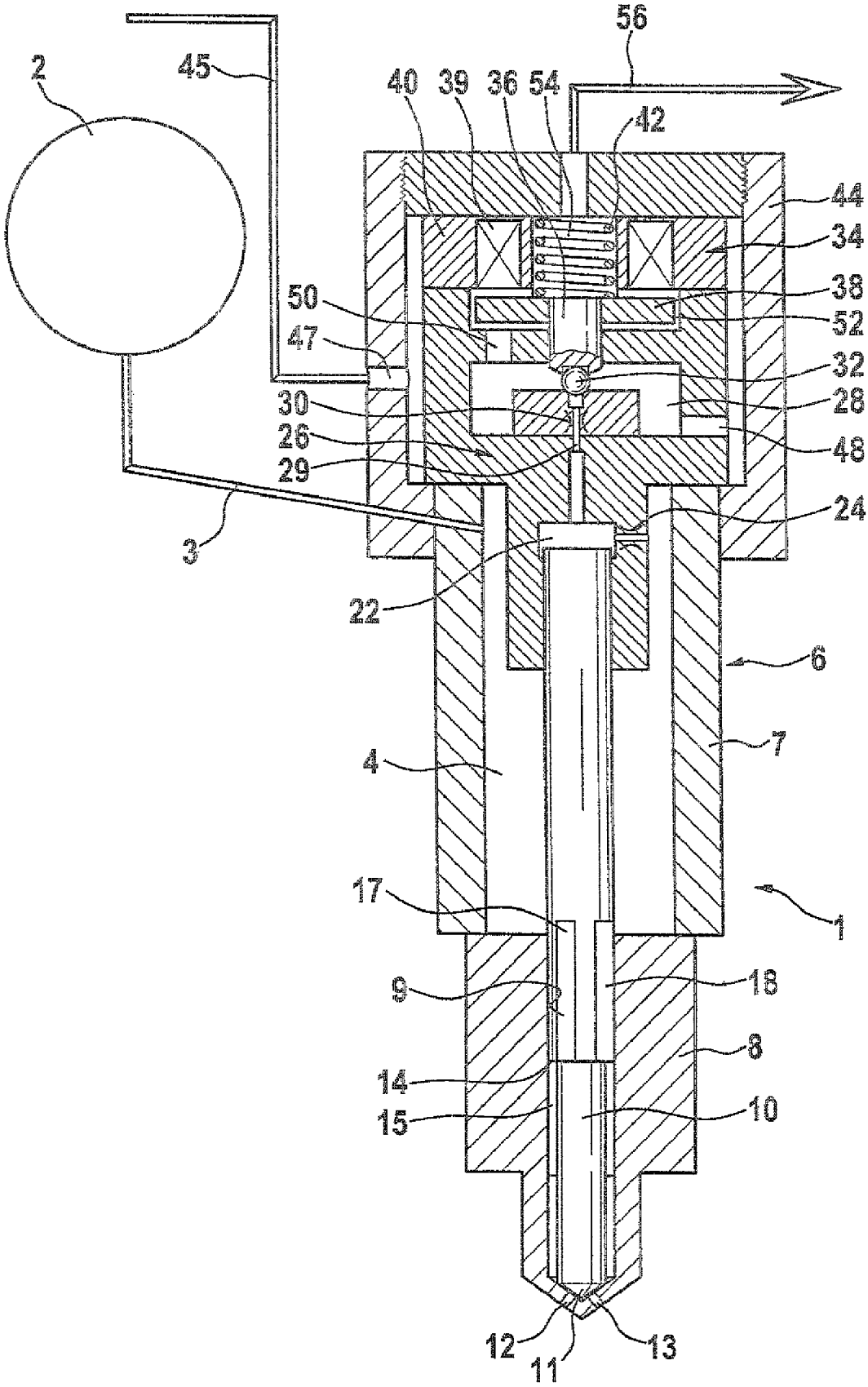
56
2
45
40
39
36
54
42
44
34
38
50
52
47
32
30
28
26
48
29
24
3
22
6
7
4
17
1
9
18
8
14
10
15
12
13
11

FUEL INJECTOR

CROSS-REFERENCE TO RELATED APPLICATION

This application is a 35 USC 371 application of PCT/EP2008/051118 filed on Jan. 30, 2008.

BACKGROUND OF THE INVENTION

1. Field of the Invention

An injector housing that includes a pressure chamber from which highly pressurized fuel is injected into a combustion chamber of an internal combustion chamber when the pressure in a control chamber is relieved into a pressure relief chamber with the aid of a control valve device.

2. Description of the Prior Art

In order to introduce fuel into direct-injection diesel engines, stroke-controlled fuel injection systems are used in which the injection pressure can be adapted to the load and engine speed.

OBJECT AND SUMMARY OF THE INVENTION

The object of the invention is to create a fuel injector which has a long service life even at high injection pressures.

In a fuel injector having an injector housing that includes a pressure chamber from which highly pressurized fuel is injected into a combustion chamber of an internal combustion chamber when the pressure in a control chamber is relieved into a pressure relief chamber with the aid of a control valve device, this object is attained by the fact that the injector has a low-pressure supply line that is connected to a low-pressure return via a flushing path that extends through the pressure relief chamber. The flushing path can be used to cool temperature-critical regions of the injector in the pressure relief chamber. This makes it possible to implement higher injection pressures than with conventional injectors.

A preferred exemplary embodiment of the fuel injector is characterized in that the flushing path extends along or past parts of the control valve device and/or an actuator. In order to achieve extremely high injection pressures, fuel injectors can be embodied in leakage-reduced or leakage-free designs by omitting a low-pressure stage. This makes it possible to significantly reduce the return quantity of the injector. Essentially, the control quantity of the servo circuit remains, but assumes very high temperatures because the control quantity is released from the system pressure via an outlet throttle. In the context of the present invention, it has turned out that particularly in injector designs in which the control valve device and the associated actuator are situated in the injector head, the temperature in the head region exceeds the permissible range. In the head region, the heat dissipation via the injector housing is low. This reduces the service life of actuators such as solenoid actuators or piezoelectric actuators. The flushing path according to the invention makes it possible to selectively cool, at least partially, temperature-critical parts of the control valve device and/or actuator.

Another preferred exemplary embodiment of the fuel injector is characterized in that the low-pressure supply line and the low-pressure return are connected to the end of the injector housing oriented away from the combustion chamber. The end of the injector housing oriented away from the combustion chamber is also referred to as the injector head. In the fuel injector according to the invention, the control valve device and/or the actuator is/are preferably situated in the injector head.

Another preferred exemplary embodiment of the fuel injector is characterized in that the control chamber and the pressure relief chamber are connected to each other via a connecting conduit that extends through a valve component along which or past which the flushing path extends. A closure member of the control valve device is able to close the connecting conduit.

Another preferred exemplary embodiment of the fuel injector is characterized in that the connecting conduit in the valve component has an outlet throttle and the flushing path extends along or past the region of the valve component in which the outlet throttle is situated. When the control valve device opens, the outlet throttle releases a control quantity into the pressure relief chamber.

Another preferred exemplary embodiment of the fuel injector is characterized in that the flushing path extends along or past the mouth region in which the connecting conduit feeds into the pressure relief chamber. This offers the advantage that the fuel heated by means of the outlet throttle is immediately mixed with cool fuel.

Another preferred exemplary embodiment of the fuel injector is characterized in that the pressure relief chamber is connected to an actuator chamber containing an actuator, along which or past which the flushing path extends. The actuator is preferably the armature of a solenoid valve that cooperates with an electromagnet of the control valve device. The actuator can, however, also be a piezoelectric actuator.

Another preferred exemplary embodiment of the fuel injector is characterized in that the actuator is attached to a valve needle along which or past which the flushing path extends. This makes it possible to cool the valve needle a simple way.

Another preferred exemplary embodiment of the fuel injector is characterized in that the valve needle has a closure member attached to it, along which or past which the flushing path extends. The closure member is used to close and selectively open the connecting conduit.

BRIEF DESCRIPTION OF THE DRAWINGS

The invention will be better understood and further objects and advantages thereof will become more apparent from the ensuing detailed description of a preferred embodiment taken in conjunction with the drawing, in which:

FIG. 1 depicts a schematic longitudinal section through a fuel injector according to the invention.

DESCRIPTION OF THE PREFERRED EMBODIMENT

The accompanying FIGURE depicts a schematic longitudinal section through a fuel injector 1. The fuel injector 1 is supplied with highly pressurized fuel from a high-pressure reservoir 2 or more precisely, a high-pressure fuel source. A supply line 3 connects the fuel injector 1 to the high-pressure reservoir 2. Inside the fuel injector 1, the supply line 3 feeds into a high-pressure connection chamber 4, which is enclosed by an injector housing 6.

The injector housing 6 encloses an injector body 7 and a nozzle body 8 equipped with a central guide bore 9. A nozzle needle 10 is guided so that it is able to move back and forth in the guide bore 9. The nozzle needle 10 has a tip 11 that opens or closes a flow connection between injection openings 12, 13 and a pressure chamber 15 when the nozzle needle 10 moves away from or toward the combustion chamber.

The nozzle needle 10 has a pressure shoulder 14 formed onto it, which is situated in the pressure chamber 15. The nozzle needle 10 is also provided with flattened regions 17, 18, which permit fuel to travel through from the high-pressure connection chamber 4 into the pressure chamber 15.

The end of the nozzle needle 10 oriented away from the combustion chamber delimits a control chamber 22 that is connected to the high-pressure connection chamber 4 via a connecting conduit 24 that is equipped with an inlet throttle. The connecting conduit 24 with the inlet throttle serves to fill the control chamber 22 with highly pressurized fuel. The control chamber 22 is recessed into a valve component 26 that can be composed of a single part or of several parts. The connecting conduit 24 extends through a part of the valve component 26. Another connecting conduit 29 that is equipped with an outlet throttle 30 extends through the valve component 26 from the control chamber 22 to a pressure relief chamber 28. The mouth region of the connecting conduit 29 can be closed by means of a closure member 32 that is associated with a control valve device 34. The control valve device 34 serves to control the opening movement of the nozzle needle 10.

The closure member 32 is situated at the combustion chamber end of a valve needle 36 that is affixed to an actuator. The actuator is an armature 38 that cooperates with a coil 39 of an electromagnet 40. The armature 38 is prestressed by means of a return spring 42 so that the closure member 32 closes the connecting conduit 29 equipped with the outlet throttle 30. If the coil 39 is supplied with current, then the electromagnet 40 attracts the armature 38 so that the closure member 32, which in this instance is embodied in the form of a ball, lifts away from an associated seat and opens the connecting conduit 29 equipped with the outlet throttle 30. The highly pressurized fuel in the control chamber 22 is then released into the pressure relief chamber 28.

The control valve device 34 with the armature 38 is accommodated in the end of the fuel injector 1 oriented away from the combustion chamber, which is also referred to as the injector head or injector housing head 44. In conventional fuel injectors, the pressure relief chamber 28 is connected to a fuel tank via a return line. According to an essential aspect of the invention, the temperature issue is addressed through a proposed cooling of temperature-critical regions in the injector head 44 by means of a low-pressure circuit of the injection system. To accomplish this, the fuel on the low-pressure side is conveyed to the injector 1, flushes through the injector 1, and is then conveyed back in the return. This makes it possible to cool critical regions, in particular the injector head 44 with the control valve device 34. In this case, it is possible for a low-pressure pump to convey the fuel in the circuit through all of the injectors of an injection system in sequence in order to reduce the complexity of line routing. Alternatively, each injector can be equipped with a supply line and a return.

In the form of a cooling flow that is also referred to as a flushing flow or flushing path, the low-pressure fuel is supplied to the injector head 44 via a low-pressure line 45. The low-pressure fuel travels into the pressure relief chamber 28 via through openings 47, 48. The cooling flow or flushing path is embodied so that critical locations on the valve component 26 are cooled, in particular the regions in which the outlet throttle 30 is accommodated. In addition, the cooling flow or flushing path extends past the mouth region of the connecting conduit 29 into the pressure relief chamber 28. This offers the advantage that the fuel heated by means of the outlet throttle 30 is immediately mixed with cool fuel.

The cooling flow or flushing path extends through another through opening 50 from the pressure relief chamber 28 into an armature chamber 52 in which the armature 38 is accommodated. From the armature chamber 52, the cooling flow travels into a low-pressure return 56 via a return spring chamber 54 that contains the return spring 42.

The opening and closing movement of the nozzle needle 10 is controlled by the control valve device 34. The associated control with the throttles in the connecting conduits 24 and 29 is also referred to as servo control. When the control valve device 34 opens, heated fuel flows out of the control chamber 22, through the connecting conduit 29 and outlet throttle 30, and into the pressure relief chamber 28. The heated fuel mixes with the cooling flow in the pressure relief chamber 28.

In the context of the present invention, the expression "low pressure" is understood to mean a pressure significantly lower than the high pressure, which is furnished by the high-pressure fuel source 2 and prevails in the high-pressure connection chamber 4 and pressure chamber 15. The low pressure is furnished via the low-pressure supply line 45. Between the low-pressure supply line 45 and the low-pressure return 56, there is a pressure difference that produces a cooling flow along the flushing path through the injector head 44. The low-pressure return 56 is connected, for example, to a fuel tank.

The foregoing relates to the preferred exemplary embodiment of the invention, it being understood that other variants and embodiments thereof are possible within the spirit and scope of the invention, the latter being defined by the appended claims.

The invention claimed is:

1. A fuel injector having an injector housing that includes a pressure chamber from which highly pressurized fuel is injected into a combustion chamber of an internal combustion chamber when the pressure in a control chamber is relieved into a pressure relief chamber with the aid of a control valve device, and a low-pressure supply line that is connected to a low-pressure return via a flushing path that extends through the pressure relief chamber, wherein the control chamber and the pressure relief chamber are connected to each other via a connecting conduit that extends through a valve component along which or past which the flushing path extends, and wherein the connecting conduit in the valve component has an outlet throttle, the valve component includes a ball shaped closure member, and the flushing path extends along or past the ball shaped closure member of the valve component close to where the outlet throttle is situated.

2. The fuel injector as recited in claim 1, wherein the flushing path extends along or past parts of an actuator.

3. The fuel injector as recited in claim 2, wherein the low-pressure supply line and the low-pressure return are connected to an end of the injector housing oriented away from the combustion chamber.

4. The fuel injector as recited in claim 1, wherein the low-pressure supply line and the low-pressure return are connected to an end of the injector housing oriented away from the combustion chamber.

5. The fuel injector as recited in claim 1, wherein the valve component includes a mouth region where the connecting conduit discharges into the pressure relief chamber, and the flushing path extends close to the mouth region where the connecting conduit feeds into the pressure relief chamber.

6. The fuel injector as recited in claim 1, wherein the pressure relief chamber is connected to an actuator chamber containing an actuator, along which or past which the flushing path extends.

7. A fuel injector having an injector housing that includes a pressure chamber from which highly pressurized fuel is injected into a combustion chamber of an internal combustion chamber when the pressure in a control chamber is relieved into a pressure relief chamber with the aid of a control valve device, and a low-pressure supply line that is connected to a low-pressure return via a flushing path that extends through the pressure relief chamber, wherein the control chamber and the pressure relief chamber are connected to each other via a connecting conduit that extends through a valve component along which or past which the flushing path extends, and wherein the valve component includes a mouth region where the connecting conduit discharges into the pressure relief chamber, and the flushing path extends close to the mouth region where the connecting conduit feeds into the pressure relief chamber.

8. The fuel injector as recited in claim 7, wherein the connecting conduit in the valve component has an outlet throttle, the valve component includes a ball shaped closure member, and the flushing path extends along or past the ball shaped closure member of the valve component close to where the outlet throttle is situated.

9. The fuel injector as recited in claim 7, wherein the pressure relief chamber is connected to an actuator chamber containing an actuator, along which or past which the flushing path extends.

10. The fuel injector as recited in claim 9, wherein the actuator is attached to a valve needle and the flushing path extends past the valve needle and directly in contact therewith.

11. The fuel injector as recited in claim 10, wherein the valve needle has a ball shaped closure member attached to it, and the flushing path extends directly in contact with the ball shaped closure member.

12. A fuel injector having an injector housing that includes a pressure chamber from which highly pressurized fuel is injected into a combustion chamber of an internal combustion chamber when the pressure in a control chamber is relieved into a pressure relief chamber with the aid of a control valve device, and a low-pressure supply line that is connected to a low-pressure return via a flushing path that extends through the pressure relief chamber, wherein the pressure relief chamber is connected to an actuator chamber containing an actuator, along which or past which the flushing path extends, and wherein the actuator is attached to a valve needle and the flushing path extends past the valve needle and directly in contact therewith.

13. The fuel injector as recited in claim 12, wherein the control chamber and the pressure relief chamber are connected to each other via a connecting conduit that extends through a valve component along which or past which the flushing path extends.

14. The fuel injector as recited in claim 12, wherein a connecting conduit in the valve component has an outlet throttle, the valve component includes a ball shaped closure member, and the flushing path extends along or past the ball shaped closure member of the valve component close to where the outlet throttle is situated.

15. The fuel injector as recited in claim 12, wherein the valve needle has a ball shaped closure member attached to it, and the flushing path extends directly in contact with the ball shaped closure member.

* * * * *